US012715640B2

(12) United States Patent
Holderman

(10) Patent No.: US 12,715,640 B2
(45) Date of Patent: Aug. 25, 2026

(54) HEAT SHRINK PACKAGING SYSTEM

(71) Applicant: Mark W. Holderman, Spokane, WA (US)

(72) Inventor: Mark W. Holderman, Spokane, WA (US)

( * ) Notice: Subject to any disclaimer, the term of this patent is extended or adjusted under 35 U.S.C. 154(b) by 0 days.

(21) Appl. No.: 19/195,937

(22) Filed: May 1, 2025

(65) Prior Publication Data

US 2025/0340320 A1 Nov. 6, 2025

Related U.S. Application Data

(60) Provisional application No. 63/640,990, filed on May 1, 2024.

(51) Int. Cl.
*B65B 53/00* (2006.01)
*B65B 53/06* (2006.01)

(52) U.S. Cl.
CPC ..... *B65B 53/063* (2013.01)

(58) Field of Classification Search
CPC ..... B65B 53/063
See application file for complete search history.

(56) References Cited

U.S. PATENT DOCUMENTS 3,727,324 A * 4/1973 Melgaard ..... B65B 53/063 34/233
3,744,146 A * 7/1973 Nichols ..... B65B 53/063 34/212
4,054,474 A * 10/1977 Collins, III ..... B29C 53/50 53/399
5,193,290 A * 3/1993 Tolson ..... B65B 53/04 53/442
5,341,623 A * 8/1994 Siegel ..... B29C 66/4312 53/433
5,544,470 A * 8/1996 Yarbrough ..... B65B 53/02 53/442

* cited by examiner

*Primary Examiner* — Eyamindae C Jallow
(74) *Attorney, Agent, or Firm* — Arenberg Goldgehn Davis & Garmisa

(57) ABSTRACT

The present apparatus and system relate to a shrink wrap packaging system. The system includes an oven that is a cavity with heating elements positioned inside. A cooling bar traverses the oven. Dies on a conveyor hold packages with shrink wrap sleeves fitted thereon and move the packages through the oven. The cooling bar thermally affects the shrink wrap sleeves such that the sleeves do not immediately begin to shrink as they enter the oven. Rather the cooling bar protects the upper portion of the sleeve such that the entirety of the sleeve shrinks in a more uniform manner as the packages traverse the oven.

13 Claims, 8 Drawing Sheets

HEAT SHRINK PACKAGING SYSTEM

CROSS REFERENCE TO RELATED APPLICATIONS

This application claims priority to and incorporates by reference in its entirety and for all purposes U.S. Provisional Patent Application Ser. No. 63/640,990 filed on behalf of Mark W. Holderman on May 1, 2024.

BACKGROUND

There are presently available machines that are adapted to inject preroll paper cones with a fluid. Examples of such machines and the resultant fluid injected prerolls are disclosed in PCT patent application serial number PCT/US19/26711 filed on behalf of Mark W. Holderman and Gregory August Russell, U.S. Provisional Patent Application Ser. No. 62/662,918 filed on behalf of Mark W. Holderman and Gregory August Russell, U.S. Provisional Patent Application Ser. No. 62/783,394 filed on behalf of Mark W. Holderman and Gregory August Russell, and PCT/US19/26711 filed on behalf of Mark W. Holderman and Gregory August Russell, each of which is incorporated by reference in its entirety and for all purposes in this application.

Once the prerolls are injected, they are placed in tubes which are then sealed with a cap. Examples of the tube packaging of prerolls is described in U.S. patent application Ser. No. 17/556,369 filed on behalf of Travis Honda, which is incorporated by refereeing in its entirety and for all purposes in this application. With the cap closed, the tube and may further be sealed with a tamper-resistant plastic sleeve. Generally, tubes are between 10 and 15 cm in length, and the sleeves are between 2 and 3 cm (though larger or smaller tubes and sleeves could be used).

The sleeves are made from a thin cylinder of plastic that shrinks when exposed to heat. In practice, a sleeve is placed around the circumference of the top portion of the tube so that a portion of the sleeve surrounds the tube while a portion of the sleeve extends above the tube. The sleeve and tube are exposed to a heat source and the sleeve shrinks around the circumference of the tube while the portion extending above the tube shrinks further, progressing inward toward a center axis of the tube. In this way, the sleeve circumferentially covers a portion of the cap (a center portion may remain uncovered while the entire circumference is covered) which prevents the cap from being opened without damaging the sleeve.

A problem arises in the shrinking of the sleeves around preroll cone tubes. The tubes themselves may be tapered, more in the shape of a frustum than a perfect cylinder so the at the top portion (at the cap) is larger in diameter than the bottom portion. The tubes also have a hinge connecting the cap to the tube that may extend beyond the outer circumference of the tube. The cap or tube may also include a tab that extends beyond the outer circumference of the tube. These extending hinge and tab portions interrupt the even shrinkage of the sleeve. The taper of the tube may also cause uneven shrinkage of the sleeve as does the exposure of the sleeve above the top of the tube. When the tubes and sleeves are exposed to a heat source, such as an infrared conveyor heater, the sleeves shrink unevenly, tend to creep upward off the top of the tube, and that results in an uneven tamper-resistant seal that may have an excess of material covering the cap, be positioned askew on the tube, or result in a sloppy, unprofessional appearance. Accordingly, there is a need for a packaging system that can accommodate the conical or frustum shaped tubes while ensuring that the tamper-resistant sleeves shrink evenly to result in an effective and aesthetically pleasing final packaged product.

SUMMARY

The present apparatus and system may be adapted for uniformly shrinking sleeves around preroll tubes. Generally, it includes a conveyor that accommodates one or more tubes. The conveyor may include tube holders, such as a plurality of dies, each having a cavity positioned within the die to hold a tube in an upright position. It should be understood that the "tube" is simply the product that will be shrink wrapped. The tube need not be a traditional tube (such as a hollow cylinder) but can be a variety of shapes so long as the product accommodates a shrink-wrap sleeve. However, as the present system works well with traditional tubes, the products accommodated by the dies will generally be referred to as tubes herein. The dies hold the tubes so that a portion, such as the bottom half to three-quarters, of the tube is within the cavity while another portion containing the cap of the tube is exposed. It was found that aluminum dies work well for acting as a heat sink to protect the tubes while also being resistant to wear and damage from repeatedly accommodating tubes and passing through a heat source.

The system includes a heat source such as an infrared heater. The heater is positioned on either side of the conveyor so that the dies holding the tubes may pass through the heater. Essentially, the heat source acts as a linear oven that has an entrance opening and an exit opening though which the dies and tubes may pass, and though other systems for providing heat could work, such as hot air or flame, the infrared heat source is reliable, even, and easily controllable. Hereinafter, for ease of reference, the heat source will simply be referred to as an oven. The oven projects heat at either side of the tubes passing through it, thereby heating the sleeves surrounding the tubes and shrinking them.

A further aspect of the system is a cooling bar. The cooling bar traverses the length of the oven. It is positioned above the dies of the conveyor such that tubes held in the dies may readily pass through the oven without being blocked by the cooling bar. The cooling bar itself may be a bar of aluminum with an internal cavity through which a coolant is flowed. This allows the cooling bar to remain cooler than the infrared heaters.

The precise distance for the placement of the cooling bar is dictated by the height of the tubes and height of the sleeves above the tubes. It was found that the height of the tube should be such that it is fully within the oven so that the infrared heaters project heat beneath the cooling bar, but also low enough so that the tops of the sleeves initially just brush against the bottom of the bar. While the sleeves should contact the bar, they should not have too much sleeve material drag along the bar or be so close that it substantially deforms the sleeves as the tube and sleeves pass through the oven. For example, the offset between the top of the sleeve and the bottom of the cooling bar should be approximately one to five millimeters, and preferable approximately one and two millimeters. The bottom of the cooling bar may further be coated with a non-stick surface or coating. This helps the sleeves smoothly slide along the cooling bar as the tubes traverse the oven.

The cooling bar disrupts the temperature within the oven and at the tops of the sleeves. This allows the portion of the sleeves that surround the tubes to rise in temperature more evenly with the exposed tops. The result is that the tops of the sleeves (i.e. the exposed portion) and the bottoms of the sleeves (i.e. the portion surrounding the tube) heat more evenly to each other than they otherwise would without the bar, and this results in even shrinking of the sleeves around the tube while preventing the tops from shrinking too early and pulling the bottom up and distorting the bottom before the bottom can fully shrink.

Further embodiments and structures of the present apparatus and system will be apparent to one of ordinary skill in the art in view of the description and drawings detailed below.

DETAILED DESCRIPTION OF EMBODIMENTS

Figure 1:
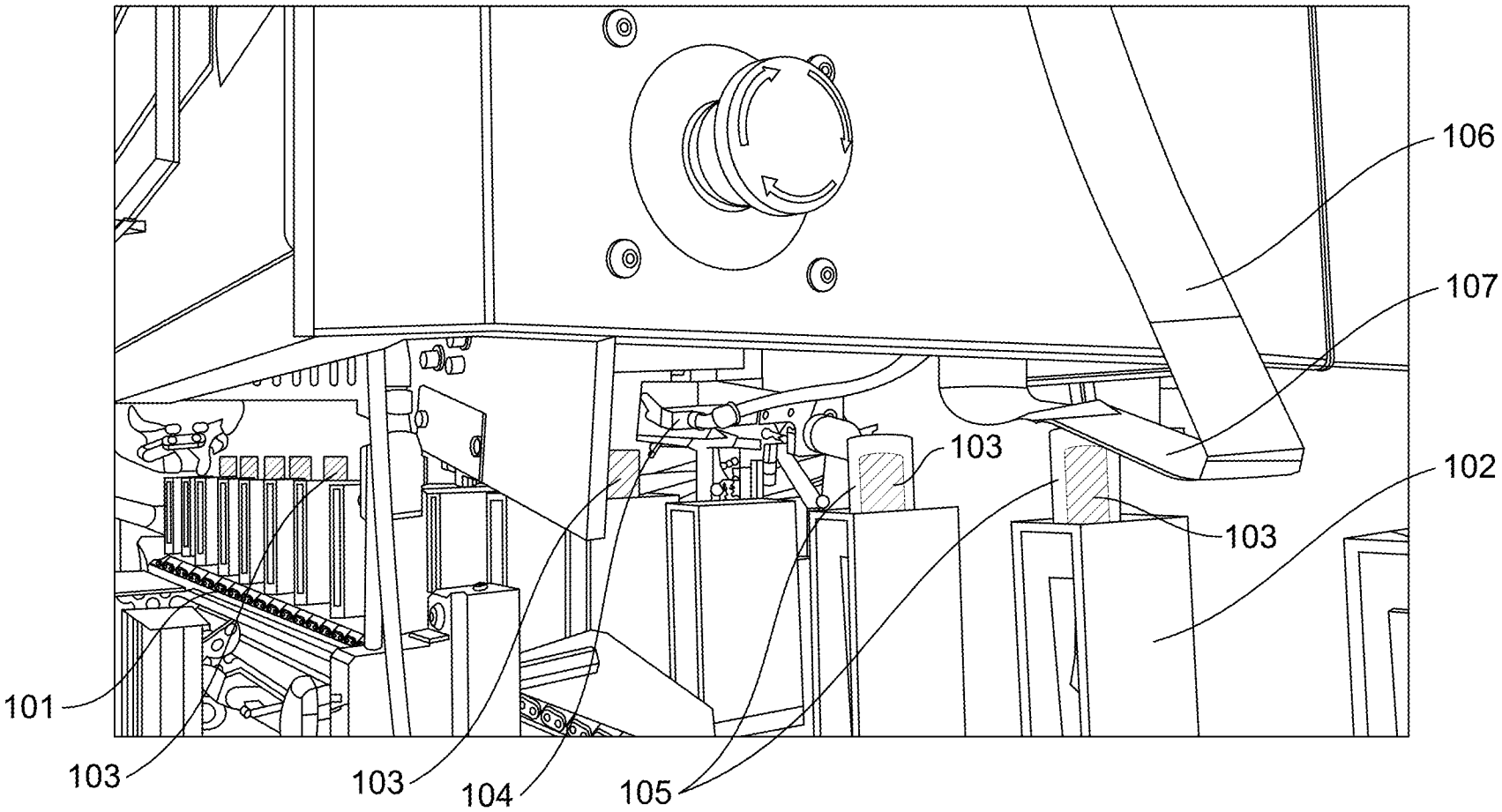
FIG. 1 is a depiction of an embodiment of a preparation section for arranging tubes and sleeves within dies of a conveyor.

Throughout the specification, wherever practicable, like structures will be identified by like reference numbers. Unless expressly stated otherwise, the term "or" means "either or both" such that "A or B" includes A alone, B alone, and both A and B together. "Approximately" as used herein means rounding to a scientifically significant figure.

The packaging apparatus is generally two main components. A first portion of the overall machine is a preparation section. In the preparation section, tubes are deposited into the dies of the conveyor, then sleeves are deposited onto the tubes within the dies of the conveyor. A second portion of the machine, the sealing portion, is the oven with cooling bar that shrinks the sleeves onto the tops of the tubes.

Respecting the preparation section, a conveyor 101 is equipped with one or more dies 102. A tube 103 is placed within the die. Sleeves 105 are placed over the top portion of the tubes. A suction 104 may be used to help position the sleeve over the tube. As the tubes exit the preparation section, a tamper 106 is positioned over the dies of the conveyor and may be used to tamp the sleeve over a tube to assist in proper positioning of the sleeve. The tamper may be in the form of a strip of plastic or metal that lightly brushes the top of the sleeve. A non-stick coating 107 on the bottom of the tamper helps prevent static buildup and ensures the tamper smoothly slides over the top of the sleeve. In the embodiment shown, the tamper is a thin strip of plastic that flexes upward as the tube passes beneath it. The weight of the tamper is sufficient to tamp the sleeve into place.

Figure 2:
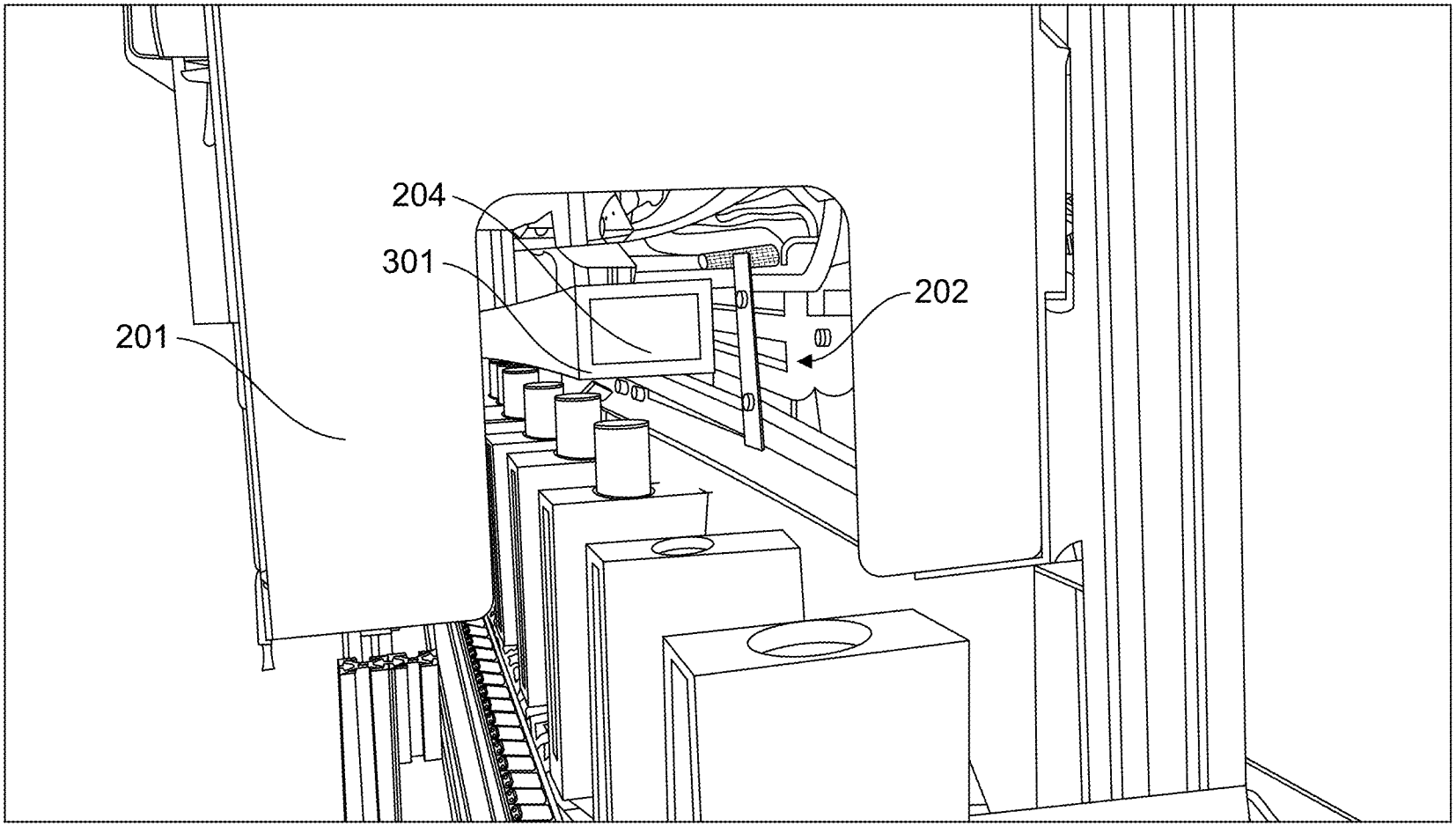
FIG. 2 is a depiction of an embodiment of the exit portion of the oven with the cooling bar arranged within it.

The conveyor then carries the tubes and sleeves through the oven. In FIG. 2, the exit of the oven 201 is shown. Within the oven there is positioned one or more heating elements 202. Generally, the oven will have complimentary heating elements on either side of the oven that each radiate heat toward the center of the oven where the tubes pass through the oven. A cooling bar 301 is positioned within the oven, separated from the heating elements and the dies. The cooling bar is raised up, above the passing dies such that there is a gap between the bottom of the cooling bar and the top of the dies. The gap is greater than the height of the tops of the tubes that are protruding from the dies. In the embodiment depicted, the coolant of the cooling bar is air. At the exit of the oven, the cooling bar is open such that air may be flowed through the bar, entering at the entrance to the oven and exiting the cooling bar at the exit of the oven.

When air is flowed through the bar, the air creates a temperature gradient across the length of the bar. That is, the portion of the cooling bar that is closest to the entrance of the oven is cooler than the portion of the cooling bar at the exit of the oven.

Figure 3:
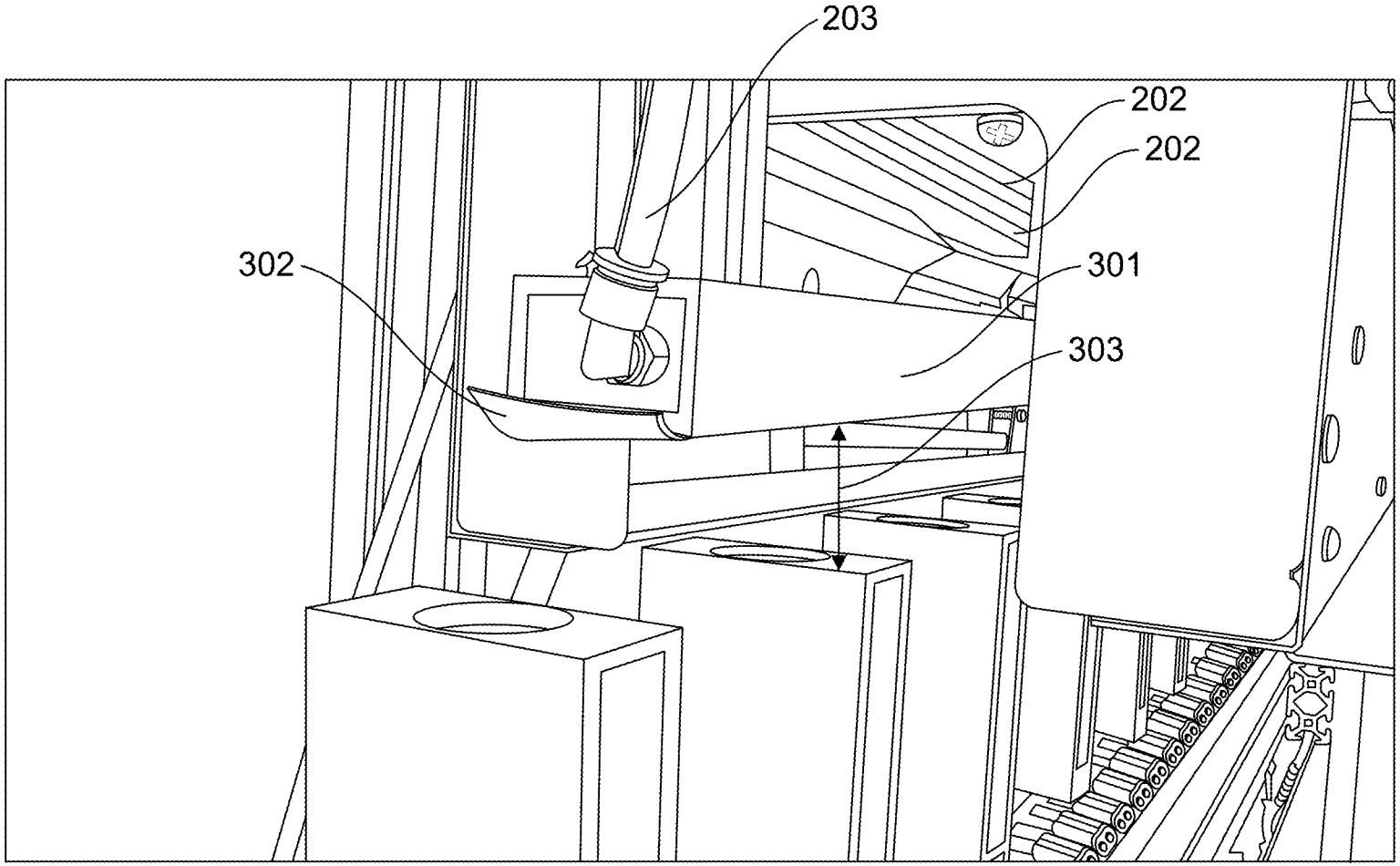
FIG. 3 is a depiction of an embodiment of the entrance portion of the oven with the cooling bar arranged within it.

FIG. 3 depicts the entrance to the oven. Cooling bar 301 extends through the oven. The cooling bar has a first, front end and a second, back end. It is arranged with the front end near the opening of the oven and the back end toward the back of the oven such that the conveyor passes dies under the font end, along the length of the cooling bar, and past the back end. A coolant exchange system is connected to the cooling bar to control the temperature of the cooling bar with respect to the temperature of the oven cavity. Coolant supply line 203 is connected to the one end of the cooling bar. The coolant may be circulated through the cooling bar to keep the cooling bar at an average temperature that is lower than that of the oven. As shown, the cooling bar may extend out of the entrance to the oven. By extending the cooling bar between 8 cm and 15 cm out of the entrance to the oven, the initial contact point between the cooling bar the sleeves remains around room temperature or at least below the temperature at which the sleeves shrink. A secondary tamper 302 may be affixed to the front end of the cooling bar. The secondary tamper may be a piece of flexible film. The flexible film may be a non-stick film that then is also formed into a non-stick coating on the underside of the cooling bar. In another embodiment, the first end (front) of the cooling bar is sloped or curved to eliminate the sharp edge of the cooling bar which could disrupt the placement of the sleeves.

As noted, the cooling bar is separated from the tops of the dies by a cooling bar height 303. This distance is such that a tube and sleeve may pass beneath the cooling bar. Preferably, the cooling bar height is the same as the height of the unshrunk sleeve so that the top of the sleeve either just brushes the bottom of the cooling bar or almost brushes it. That is the height of the cooling bar is plus or minus 1 to 2 millimeters of the height of the sleeves. If the height of the sleeve is 3 cm., then the height of the cooling bar should be between 2.8 cm and 3.2 cm.

Figure 4:
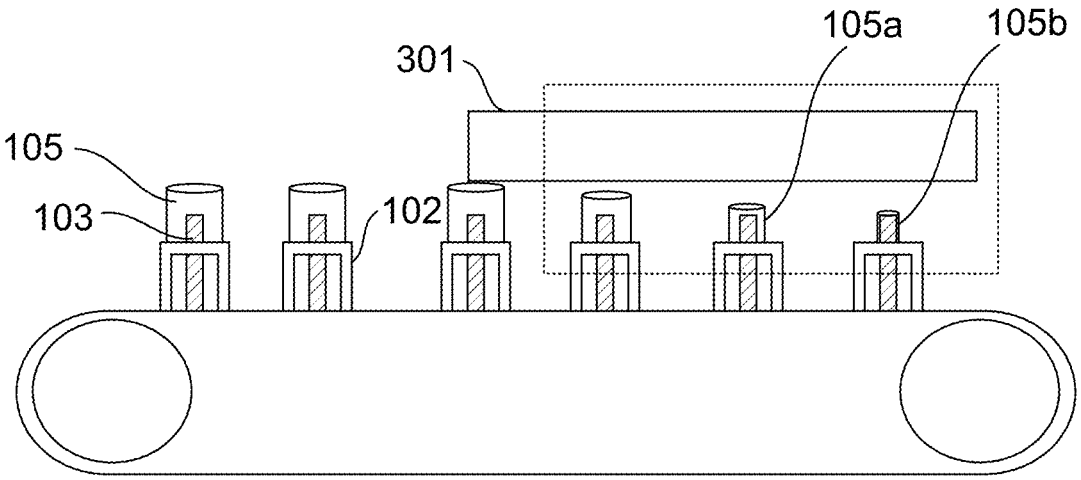
FIG. 4. is a cross-sectional view of block diagram of the cooling bar with dies holding tubes and sleeves passing through the oven (not shown).

FIG. 4 is a side view of the sealing portion. The tubes 103 with sleeves 105 are held within dies 102. The top edge of the sleeve brushes along (or approximately one or two millimeters below) the bottom of the cooling bar 301. As the tube passes through the oven, the cooling bar prevents the top portion of the sleeve from prematurely shrinking. For tubes that are approximately 2 cm in diameter, the oven may be between 60 and 90 cm long. After passing through the first quarter of the oven, the heat from the oven begins to shrink the upper portion of the sleeve and simultaneously shrink the lower portion of the sleeve that is around the tube.

Figure 5:
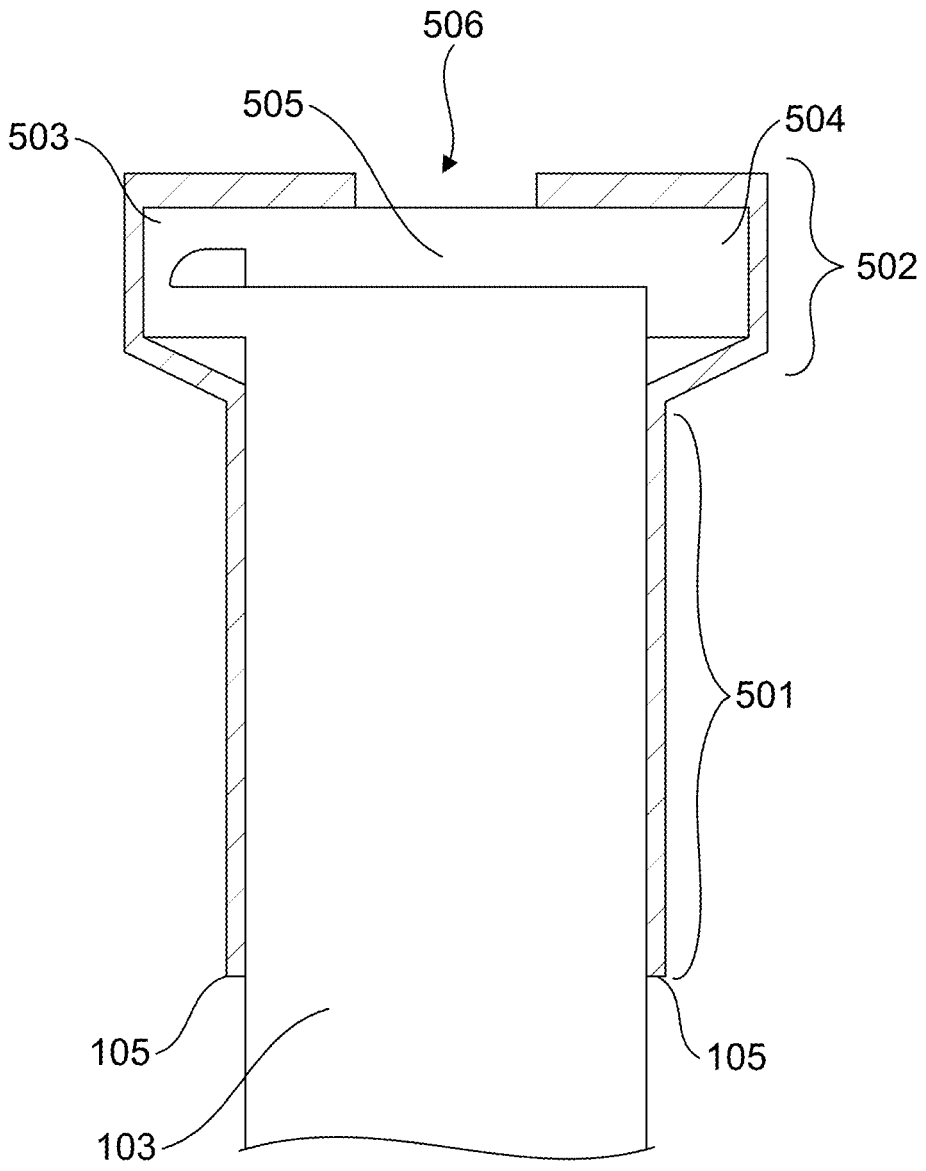
FIG. 5 is a depiction of an embodiment of an enlarged image of a tube with the sleeve shrunken around its exterior.
Figure 6:
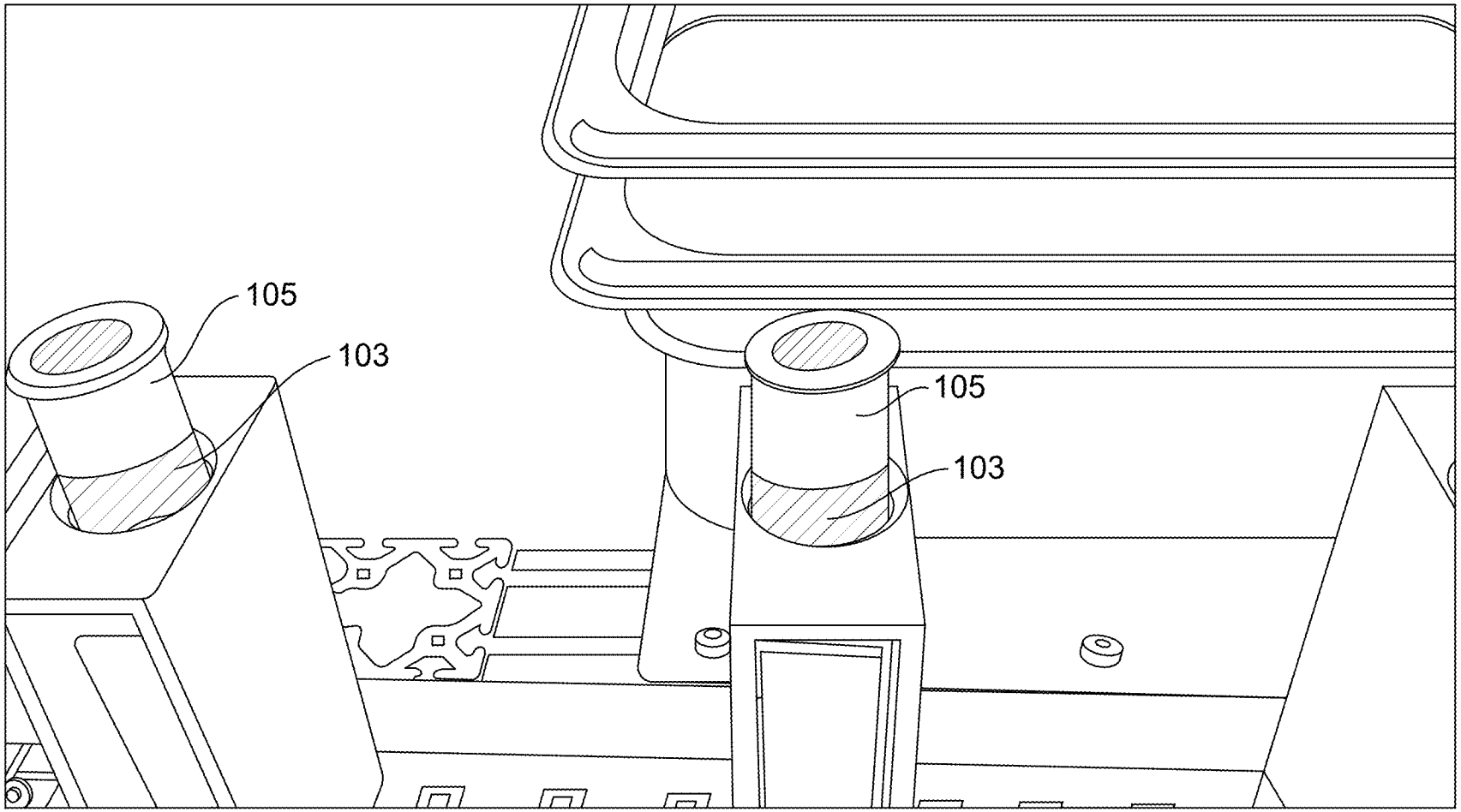
FIG. 6 is a perspective depiction of an embodiment of a sleeve sealed around a tube.
Figure 7:
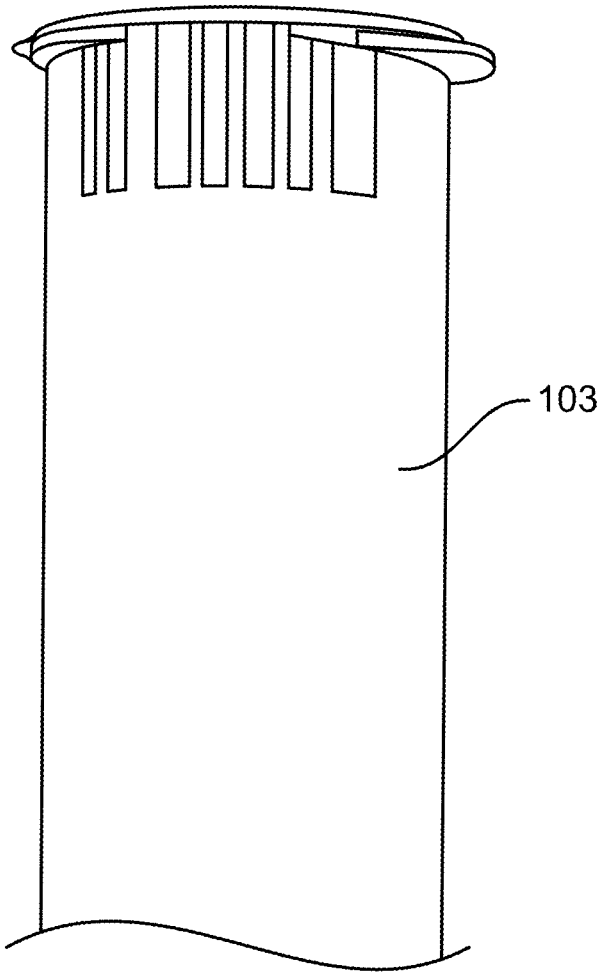
FIG. 7 is a depiction of an embodiment of a tube.
Figure 8:
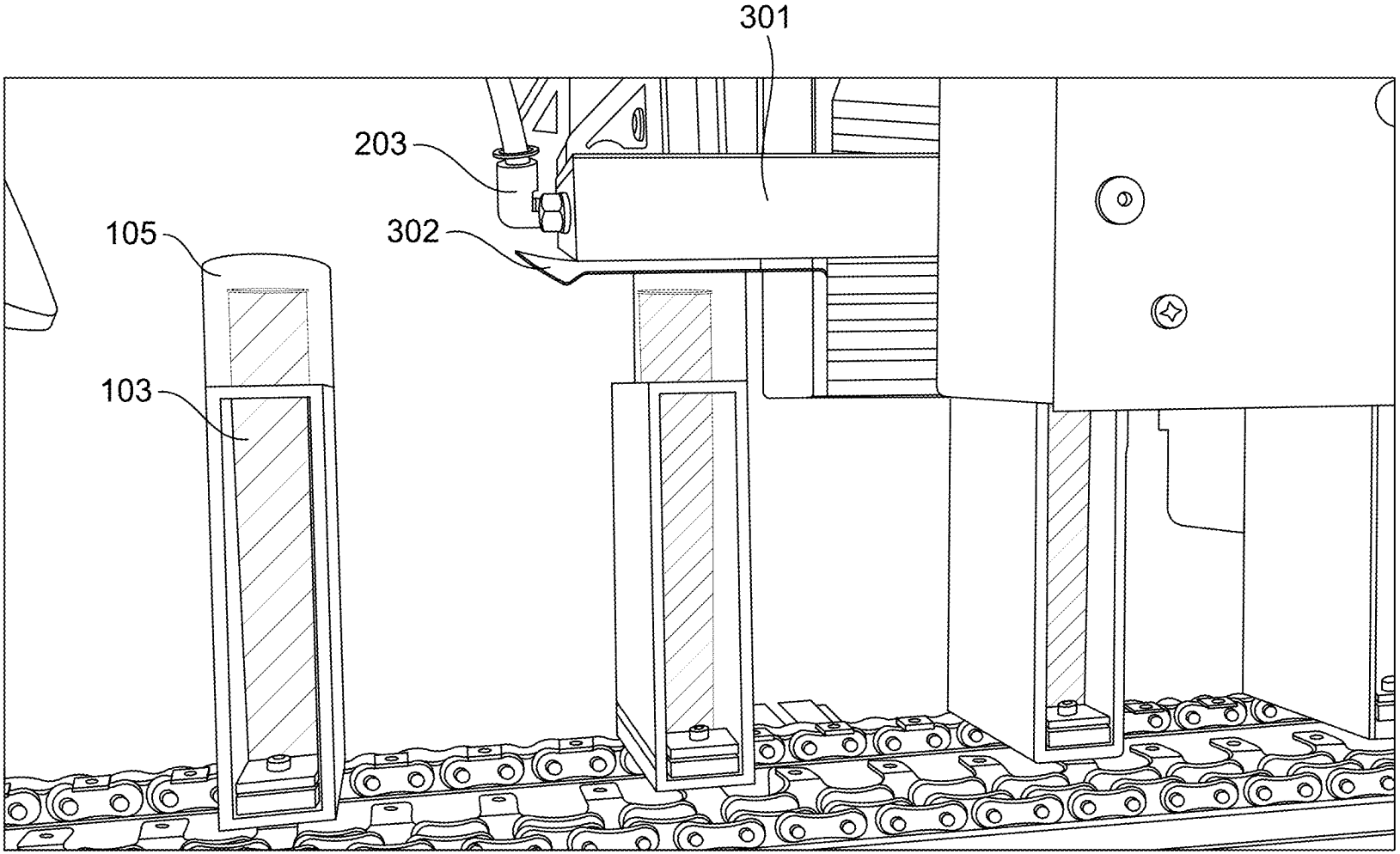
FIG. 8 is a depiction of an embodiment of the cooling bar positioned at an angle within the oven.

FIG. 5 shows a cross-section finished product, enlarged for reference. As the tubes 103 continue to pass through the oven, the bottom portion 501 of the sleeve 105 becomes fully engaged with the tube and the upper portion 502 continues to shrink around the hinge 503 and lip 504 of the tube and eventually flatten out, fully shrinking over a portion of the top 505 of the tube, leaving a small central circular area 506 of the top of the tube exposed, while completely surrounding and covering the outer circumference of the top. FIG. 6, is a perspective depiction. FIG. 7 is a depiction of a tube without a sleeve. As shown, when the package is held with in the die, the hinge and lip extend away from the sidewall of the package and toward the sleeve. Thus, the package is asymmetrical about a vertical plane of the package passing through the central axis of the package (e.g. a plane along a diameter of the package that does bisect the hinge or the tab) when the package is positioned within the die.

In one embodiment, the cooling bar is angled upward as it progresses down the length of the oven. From the entry end of the cooling bar to the exit end of the cooling bar, the bar may exhibit an angle of approximately 5 to 15 degrees. The angle of the bar ensures that in the first quarter of the oven, the bar is closer to the tops of the sleeves than it is at the end of the oven. This again assists in initially controlling the temperature at the tops of the sleeves when the tubes enter the oven, but after the bottoms of the sleeves have fully engaged the outer circumference of the tube, more of the heat is allowed to be exposed to the tops of the tube to ensure the tops are fully shrunk over the top of the tube.

The cooling bar controls the shrinking of the sleeves. Without the cooling bar, the tube affects the shrinking of the bottom portion of the sleeve such that it does not begin to shrink at the same time as the top portion. Instead, the exposed top portion of the sleeve shrinks and deforms first. That causes the sleeve to begin to progress upward on the tube. However, the protruding hinge and tab impede smooth, even upward progression of the sleeve, which then leads to sleeves that are askew and also there can be too much sleeve material overing the top of the tube.

By equipping the oven with the cooling bar, the cooling bar affects the temperature within the oven at the top portion of the sleeves. This allows the oven to heat the tops and the bottoms of the sleeves more evenly so that the bottoms and tops begin to shrink nearly simultaneously and then fully simultaneously until the bottoms are able to fully engage the outer circumference of the tube. With the bottom portion fully engaged, there is no risk of the sleeve further progressing up the tube. At this point the tubes continue through the oven where the top portion continues to shrink until it flattens out over the top of the tube.

Although the present invention has been described in terms of various embodiments, it is to be understood that such disclosure is not intended to be limiting. Various alterations and modifications will be readily apparent to those of skill in the art. Accordingly, it is intended that the appended claims be interpreted as covering all alterations and modifications as fall within the spirit and scope of the invention.

What is claimed is:

1. A packaging system comprising:

a conveyor;

a plurality of dies positioned along the conveyor, each die configured to accommodate a package;

an oven comprising a cavity with an entrance, and exit, and a heat source disposed within the cavity;

a cooling bar that is positioned above the conveyor and having a length that is in line with a direction of travel of the conveyor such that the cooling bar traverses at least a portion of the cavity;

wherein the cooling bar has a first end and a second end separated by the length where the second end is arranged closer to the exit of the oven than the first end; and wherein the cooling bar has a width perpendicular to the length and the width is shorter than the length.

2. The packaging system of claim 1, further comprising:

a coolant exchange system connected to the cooling bar and adapted to control a temperature of the cooling bar such that an average temperature across the cooling bar is less than a temperature of the oven cavity.

3. The packaging system of claim 2, wherein the cooling bar extends out of the cavity such that the first end of the cooling bar is positioned outside of the cavity while a portion of the length remain inside the cavity, wherein the oven is maintained at a temperature sufficient to shrink a shrink-wrap sleeve and, the first end of the cooling bar is maintained at a temperature that is below a temperature where a shrink-wrap sleeve shrinks.

4. The packaging system of claim 1, wherein the heat source is disposed along an interior length of the oven, on either side of the conveyor, and not directly above the conveyor or the cooling bar.

5. The packaging system of claim 1, wherein the cooling bar traverses through the oven and is parallel to the conveyor.

6. The packaging system of claim 1, wherein the heat source and the cooling bar are parallel to the conveyor.

7. The packaging system of claim 1, wherein the cooling bar is hollow and includes a connection at the first end that is connected to a coolant inlet, and wherein the second end is open such that a coolant flows out of the second end and away from the first end.

8. The packaging system of claim 1, further comprising: a package positioned within at least one of the plurality of dies and a sleeve surrounding a top portion of the package and in contact with the cooling bar.

9. The packaging system of claim 1, further comprising: a package positioned within at least one of the plurality of dies and beneath the first end of the cooling bar, and a sleeve surrounding a top portion of the package wherein the cooling bar is between one and two millimeters higher than a top-most portion of the sleeve prior to the sleeve shirking.

10. The packaging system of claim 1, wherein the oven is between 60 and 90 centimeters long, and the first end of the cooling bar protrudes between 8 and 15 centimeters out of the entrance to the oven.

11. The packaging system of claim 1, further comprising: a package positioned within at least one of the plurality of dies, and a sleeve surrounding a top portion of the package, wherein the package includes at least one protrusion that extends away from the package and toward the sleeve such that the package is asymmetrical about a vertical plane passing through a central axis of the package positioned within the die.

12. The packaging system of claim 1, wherein the cooling bar is sloped between five and fifteen degrees as it passes through the oven such that the first end of the cooling bar is higher than the back of the cooling bar.

13. A packaging system comprising:

a conveyor, a cavity containing heating elements, a cooling bar traversing a length of the cavity and positioned above the conveyor;

a die positioned on the conveyor and adapted to hold a package fitted with a shrink-wrap sleeve;

wherein, the conveyor operates to move the die past the cavity such that the heating elements heat at least a portion of a package and shrink-wrap sleeve; and wherein the die positions the shrink-wrap sleeve proximally to the cooling bar such that the uppermost portion of the sleeve is thermally affected by the cooling bar as the package traverses the cavity.

* * * * *